US010253767B2

(12) United States Patent
Minatodani

(10) Patent No.: US 10,253,767 B2
(45) Date of Patent: Apr. 9, 2019

(54) PUMP

(71) Applicant: WELCO CO., LTD., Tokyo (JP)

(72) Inventor: Yoji Minatodani, Fujisawa (JP)

(73) Assignee: WELCO CO., LTD, Tokyo (JP)

( * ) Notice: Subject to any disclaimer, the term of this patent is extended or adjusted under 35 U.S.C. 154(b) by 279 days.

(21) Appl. No.: 15/092,872

(22) Filed: Apr. 7, 2016

(65) Prior Publication Data

US 2016/0215768 A1 Jul. 28, 2016

Related U.S. Application Data

(63) Continuation-in-part of application No. PCT/JP2013/077472, filed on Oct. 9, 2013.

(51) Int. Cl.

| | |
|---|---|
| ***F04B 43/12*** | (2006.01) |
| ***F04B 43/14*** | (2006.01) |
| ***F04C 5/00*** | (2006.01) |

(52) U.S. Cl.

CPC ..... *F04B 43/1253* (2013.01); *F04B 43/14* (2013.01); *F04C 5/00* (2013.01); *F04B 43/1261* (2013.01); *F04B 43/1276* (2013.01)

(58) Field of Classification Search

CPC .. F04B 43/1253; F04B 43/14; F04B 43/1261; F04B 43/1276; F04C 5/00

USPC ..... 417/477.5, 477.9

See application file for complete search history.

(56) References Cited

U.S. PATENT DOCUMENTS 1,765,360 A * 6/1930 Baumann ..... F04B 43/0072 222/209
3,216,362 A 11/1965 Hewko
3,408,947 A * 11/1968 McMillan ..... F04B 43/14 418/45
3,507,585 A * 4/1970 Mercer ..... F04B 43/0054 417/475

(Continued)

FOREIGN PATENT DOCUMENTS

CN 85102462 9/1986
CN 85204827 10/1986

(Continued)

OTHER PUBLICATIONS

Chinese Office Action, along with its English translation issued in Chinese Application No. 201380080148.4 dated Mar. 30, 2017.

(Continued)

*Primary Examiner* — Charles G Freay
(74) *Attorney, Agent, or Firm* — McCarter & English, LLP

(57) ABSTRACT

To provide a pump whose elastic member has long life, a pump according to an embodiment of the invention comprises an inner wall surface having a cylindrical shape, an elastic ring disposed along the inner wall surface and forming an operation chamber extending in a circumferential direction of the elastic ring with respect to the inner wall surface, and a plurality of pressing members pressing a part of the elastic ring in the circumferential direction against the inner wall surface and thereby forming a blocking part in the operation chamber, wherein the plurality of pressing members cause fluid in the operation chamber to move by rotating along the inner wall surface and thereby moving the blocking part, and the elastic ring is disposed to maintain a circumference in a natural state of the elastic ring.

11 Claims, 7 Drawing Sheets

(56) References Cited

U.S. PATENT DOCUMENTS

| | | | | |
|---|---|---|---|---|
| 4,530,647 | A * | 7/1985 | Uno | F04B 43/1253 417/477.3 |
| 4,545,745 | A * | 10/1985 | Barreca | F04B 43/14 417/477.12 |
| 6,041,709 | A * | 3/2000 | Wells | B41F 31/08 101/350.6 |
| 8,747,084 | B2 * | 6/2014 | Richardson | F04B 43/1238 417/476 |
| 9,175,678 | B2 | 11/2015 | Ono et al. | |
| 2002/0127115 | A1 | 9/2002 | Lucke et al. | |
| 2012/0020822 | A1 | 1/2012 | Richardson et al. | |
| 2012/0282125 | A1 | 11/2012 | Ono et al. | |
| 2012/0288388 | A1 | 11/2012 | Ono et al. | |
| 2012/0294743 | A1 | 11/2012 | Ono et al. | |

FOREIGN PATENT DOCUMENTS

| | | |
|---|---|---|
| CN | 2074829 | 4/1991 |
| EP | 0223025 | 5/1987 |
| EP | 2397695 | 12/2011 |
| FR | 860457 A * | 6/1939 |
| FR | 958813 | 3/1950 |
| FR | 1562957 A * | 1/1968 |
| FR | 2192623 | 2/1974 |
| GB | 590045 | 7/1947 |
| GB | 768253 | 2/1957 |
| GB | 185597 | 10/1957 |
| JP | H08334087 | 12/1996 |
| JP | H10141237 | 5/1998 |
| JP | 2005-518505 | 6/2005 |
| JP | 2010-190062 | 9/2010 |
| JP | 2011-102574 | 5/2011 |
| WO | 2015052795 | 4/2015 |

OTHER PUBLICATIONS

International Search Report issued in PCT/JP2013/077472 dated Nov. 12, 2013.

Supplementary European Search Report issued in EP Application No. 13895232.0 dated Aug. 8, 2017.

English translation of Chinese Application No. 85102462, published on Sep. 24, 1986, Qingdao Whole-Sealed Corrosion-Resistant Pump Development Corp (previously cited).

Chinese Office Action, along with English translation, issued in Chinese Application No. 201380080148.4 dated Nov. 1, 2017.

Taiwanese Office Action along with English translation for Application No. TW102136699 dated Oct. 11, 2017 (10 pages).

* cited by examiner

PUMP

This is a Continuation-in-Part of International Application No. PCT/JP2013/077472 filed Oct. 9, 2013. The entire disclosure of the prior application is hereby incorporated by reference herein its entirety.

TECHNICAL FIELD

The present invention relates to a pump having an elasticity at least in a part of an operation chamber wall.

BACKGROUND

A tube pump configured such that a flexible tube is disposed in a ring-shape along a cylindrical inner wall surface formed on a housing and fluid in the tube is transported by rotating a roller along the inner wall surface while letting the roller press the tube between the roller and the inner wall surface of the housing is known (see Japanese Patent Provisional Publication No. 2011-102574A (hereafter, referred to as patent document 1)).

Since, in the tube pump of this type, a particular portion of the tube is bent by 180 degrees repeatedly, a large degree of deformation is caused locally at the particular portion of the tube, and thereby fatigue rapidly progresses. Therefore, life of the tube is relatively short in comparison with other components, such as a pump, and the tube needs to be replaced periodically as a consumable article.

Furthermore, in the tube pump, a sucking process (i.e., a process transferring from a state where a hollow part of the tube serving as an operation chamber is pressed and an cross sectional area of the hollow part becomes the minimum to a natural state where the cross sectional area of the hollow part of the tube becomes the maximum) is performed by an elastic restoring force of the tube itself. Therefore, the speed of the sucking process is low, which causes limiting the rotational speed of the pump.

U.S. Patent Application Publication No. 2012/0020822 A1 (hereafter, referred to as patent document 2) describes a pump including: a cylindrical inner wall, a cylindrical diaphragm forming a ring-shaped operation chamber between the diaphragm and the inner wall surface, a presser roller deposed to rotate along the inner wall surface while pressing the operation chamber, a ring-shaped actuator disposed between the diaphragm and the presser roller, and a support member restricting the distance between the actuator and the inner wall surface within a predetermined value.

Since, in the pump described in the patent document 2, an elastic member (diaphragm) is not pressed in a state where the elastic member is bend by 180 degrees as in the case of the above described tube pump, the local deterioration of the elastic member is suppressed. Furthermore, in the pump described in the patent document 2, the actuator which is thicker than the diaphragm is disposed between the diaphragm and the presser roller, deterioration of the diaphragm is suppressed.

SUMMARY

However, since, in the pump described in the patent document 2, a thin diaphragm having a low mechanical strength is used as an elastic member, a large degree of enhancement of life of the elastic member cannot be expected.

The present invention is made in view of the above described circumstances. That is, the object of the present invention is to provide a pump whose elastic member has long life.

According an embodiment of the invention, there is provided a pump, comprising: an inner wall surface having a cylindrical shape; an elastic ring disposed along the inner wall surface and forming an operation chamber extending in a circumferential direction of the elastic ring with respect to the inner wall surface; and a plurality of pressing members pressing a part of the elastic ring in the circumferential direction against the inner wall surface and thereby forming a blocking part in the operation chamber, the plurality of pressing members causing fluid in the operation chamber to move by rotating along the inner wall surface and thereby moving the blocking part. The elastic ring is disposed to maintain a circumference in a natural state of the elastic ring.

In the above described pump, a diameter of the inner wall surface may be slightly larger than an outer diameter of the elastic ring in the natural state. A difference between the diameter of the inner wall surface and the outer diameter of the elastic ring in the natural state may be defined to achieve a relationship that, when the elastic ring deforms due to a pumping motion, the elastic ring contacts the inner wall surface while causing almost no change with respect to the circumference of the elastic ring.

In the above described pump, an inner diameter of the elastic ring in the natural state may be smaller than a diameter of a circumscribed circle of the plurality of pressing members. The elastic ring may be configured not to expand the circumference of the elastic ring by deforming, at a part of the elastic ring not contacting the plurality of pressing members, such that curvature in the circumferential direction becomes smaller than curvature in the natural state.

In the above described pump, the inner wall surface may be formed with a sucking port through which the fluid to be transported is sucked from an outside into the operation chamber, and may be formed with a discharging port through which the fluid is discharged from an inside of the operation chamber to the outside. The elastic ring may include a division wall partitioning the operation chamber between the sucking port and the discharging port. The division wall may be an elastic plate-like member projecting from an outer circumferential surface of the elastic ring.

In the above described pump, a barycenter of the plurality of pressing members may lie on a center axis of rotation of the plurality of pressing members.

In the above described pump, the plurality of pressing members may be disposed around a center axis of the inner wall surface at constant intervals.

The pump may further comprise a rotor rotating the plurality of pressing members along an inner circumferential surface of the elastic ring while holding the plurality of pressing members to maintain a predetermined positional relationship of the plurality of pressing members.

In the pump may further comprise a sun roller disposed coaxially with a center axis of rotation of the plurality of pressing members. Each of the plurality of pressing members may be a pressing roller rotatably supported by the rotor. When the sun roller rotates, the plurality of pressing members being sandwiched between the sun roller and the inner circumferential surface of the elastic ring may rotate in the circumferential direction along an outer circumferential surface of the sun roller and the inner circumferential surface of the elastic ring. The elastic ring may be configured such that the plurality of pressing members and the sun roller can be inserted into a hollow part of the elastic ring from one side in an axis direction of the hollow part for assembling. The inner wall surface may be formed in one of a barrel shape and a conical shape in which a diameter of the inner wall surface expands toward the one side. The sun roller may have an outer circumferential surface formed in one of a barrel shape and a conical shape to be parallel with the inner wall surface.

In the above described pump, pressing forces applied from the plurality of pressing members to the sun roller may be cancelled out.

According to the embodiment of the invention, since the circumference (the length in the circumferential direction) of the elastic member is kept substantially at the natural length, it becomes possible to provide a pump whose elastic member has long life.

DETAILED DESCRIPTION OF EMBODIMENTS

In the following, an embodiment according to the invention is described with reference to the accompanying drawings.

A pump device 1 according to the embodiment of the invention described below is a pump suitable for transporting, by a constant amount, organic solvent or liquid containing a substance having a high degree of chemical activity (hereafter, referred to as "active liquid") (e.g., supplying liquid resin material for laminate shaping to a 3D printer). Needless to say, the pump device 1 is also suitable for transporting water or liquid having a low degree of chemical activity.

A conventional pump (e.g., a tube pump) used for a constant amount transporting of liquid is configured such that at least a part of an operation chamber containing liquid to be transported is formed of elastic material, such as synthetic rubber. Furthermore, when active liquid is transported, it becomes necessary to form components constituting the operation chamber with material having solvent resistance or chemical resistance. However, in general, elastic material having solvent resistance or chemical resistance has a low degree of durability (fatigue strength). In particular, regarding the configuration of the tube pump where a large degree of stress is intensively and repeatedly applied to the elastic member (the tube) during operation, it was difficult to achieve both of practical durability and solvent resistance or chemical resistance.

Furthermore, even in the case of a tube pump in which a tube formed of a general elastic member not having a high degree of solvent resistance (e.g., silicone rubber), life of the tube is relatively short in comparison with other components. For this reason, it was the object for the conventional tube pump to reduce frequency of maintenance while enhancing life of the tube.

The pump device 1 according to the embodiment provided advantageous effects in that life of an elastic member can be enhanced.

Figure 1:
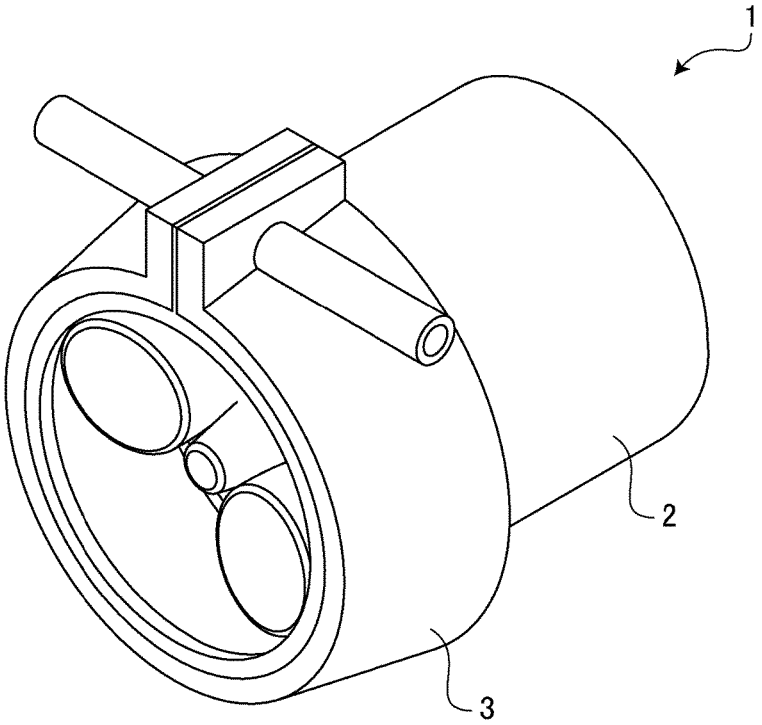
FIG. 1 illustrates an outer appearance of a pump device according to an embodiment of the invention.

FIG. 1 illustrates an outer appearance of the pump device 1. In the following explanation, a lower left side in FIG. 1 is referred to as a front side (a front direction), an upper right side in FIG. 1 is referred to as a rear side (a rear direction), am upper side in FIG. 1 is referred to as an upper side (an upper direction), a lower side in FIG. 1 is referred to as a lower side (a bottom direction), an upper left side in FIG. 1 is referred to as a left side, and a lower right side in FIG. 1 is referred to as a right side.

The pump device 1 includes a pump unit 3, a drive unit 2 which drives the pump unit 3, and a casing (not shown) which accommodates and holes the pump unit 3 in an assembled state. The drive unit 2 includes a motor (not shown), a control circuit (not shown) which drives and controls the drive unit 2, and a power supply (not shown) which supplies electric power to the motor and the control circuit. As described later, in this embodiment, the drive unit 2 is not provided with a reduction gear because the pump unit 3 has the function of reducing the rotational output of the drive unit 2 and amplifying torque. The torque required for driving the pump unit 3 varies depending on design (size, material, viscosity of liquid to be transported, etc.) of the pump unit 3. Therefore, when a large degree of torque is required, the drive unit 2 may be provided with a reduction gear. Furthermore, a housing of the drive unit 2 is attached to a rear surface of the pump unit 3, and a drive shaft 2*a* of the drive unit 2 is inserted into and connected to the inside of the pump unit 3.

The drive unit 2 includes an input terminal (not shown) which receives an external control signal, and an operation switch (not shown) which receives a user operation. The drive unit 2 controls driving of the built-in motor based on the control signal inputted to an input port or a user operation to the operation switch, and outputs a rotational driving force via the drive shaft 2*a*. The driving may be controlled by ON/OFF of an external power source (e.g., power supplied from a 3D printer) inputted to the power supply.

Figure 2:
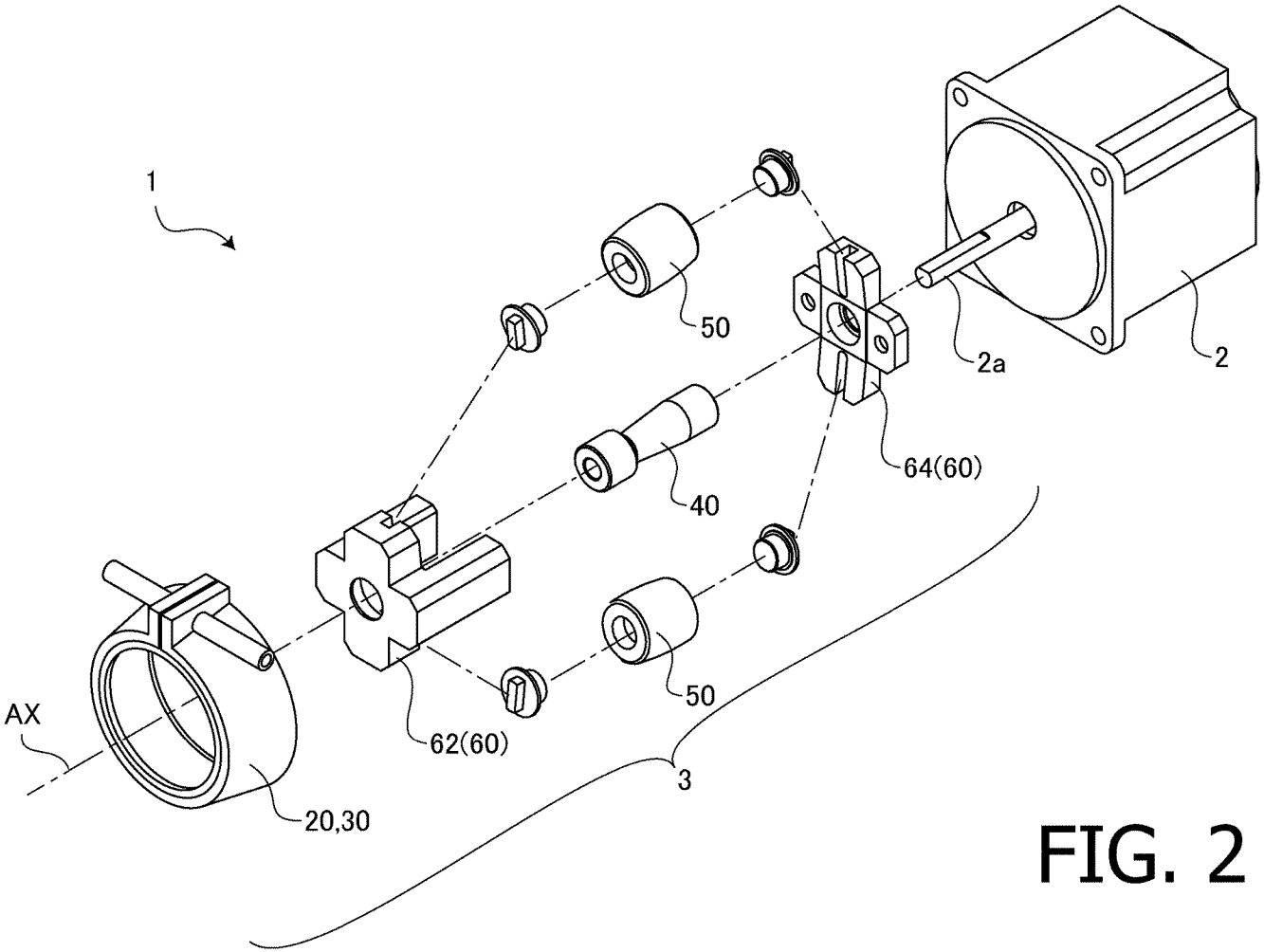
FIG. 2 is an exploded perspective view of the pump device according to the embodiment of the invention.
Figure 3:
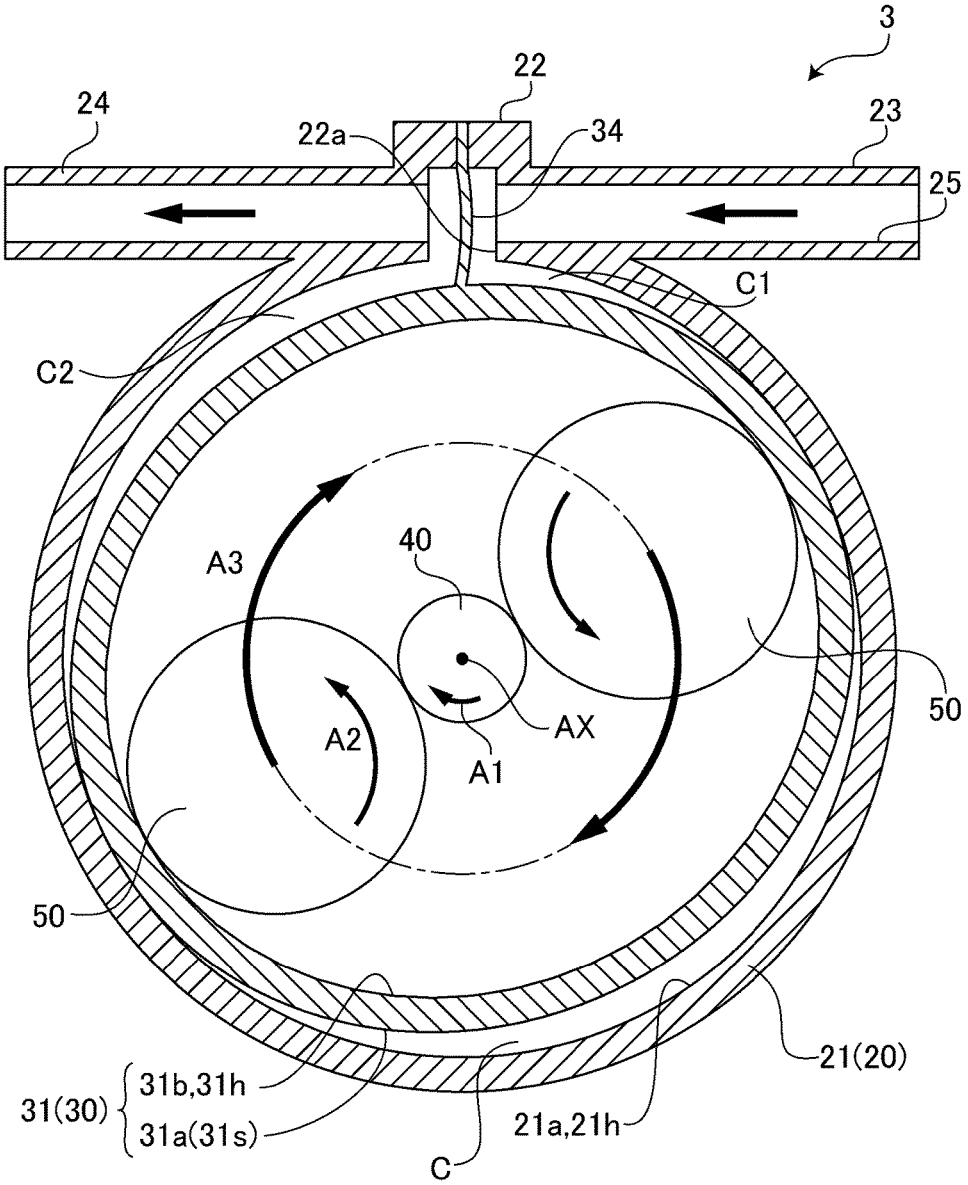
FIG. 3 illustrates a lateral cross section of a pump unit according to the embodiment of the invention.
Figure 4:
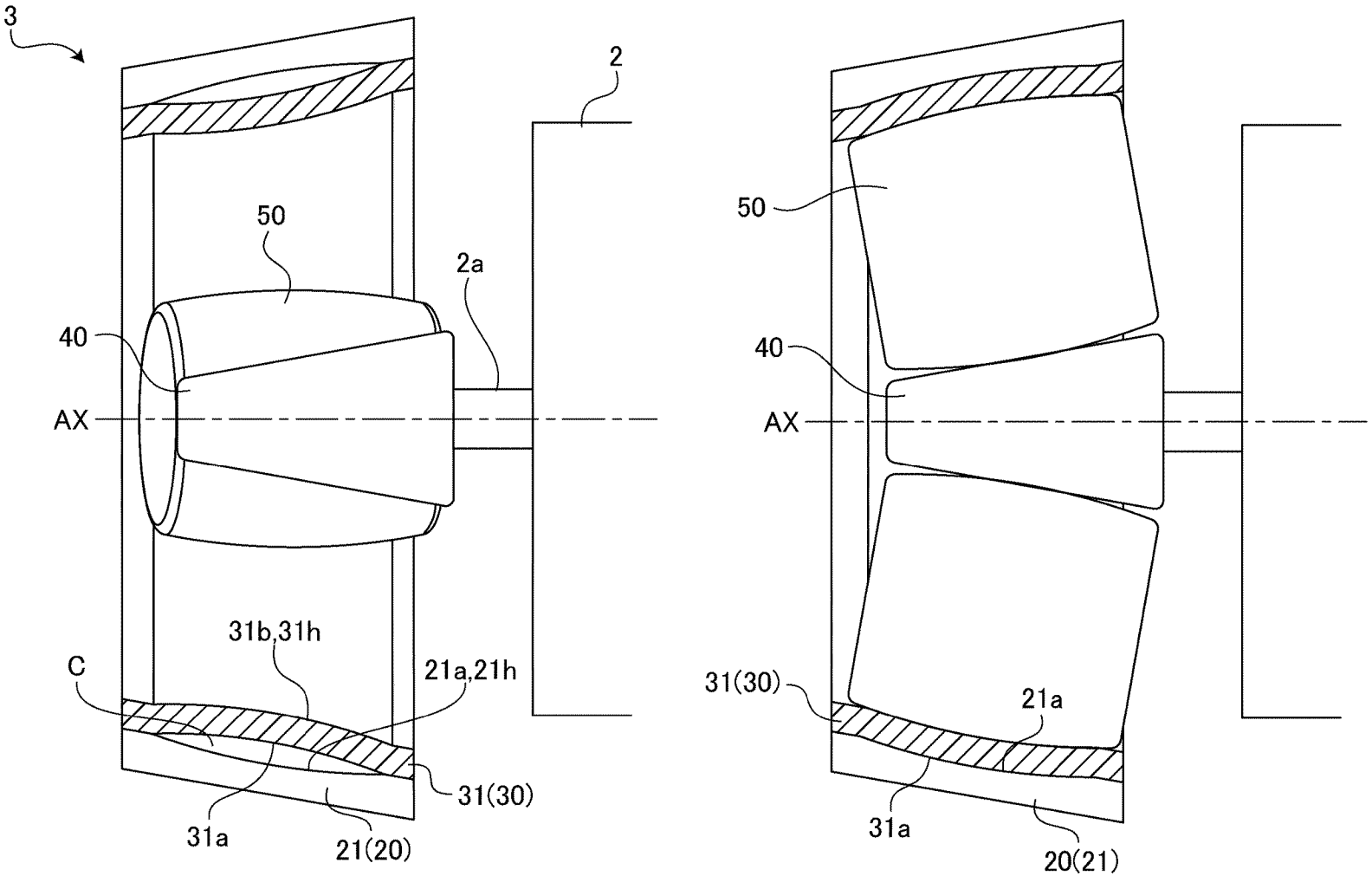
FIG. 4 illustrates a vertical cross section of the pump unit according to the embodiment of the invention.

FIG. 2 is an exploded perspective view of the pump device 1. FIG. 3 illustrates a lateral cross section of the pump unit 3 (a cross section cut by a plane perpendicular to a center axis AX). FIGS. 4(*a*) and 4(*b*) illustrate a vertical cross section of the pump unit 3. FIG. 4(*a*) is a schematic view of a vertical cross section of the pump unit 3 cut by a plane perpendicular to an arranging direction of a sun roller 40 and a pair of planetary rollers 50, and FIG. 4(*b*) is a schematic view of a vertical cross section of the pump unit 3 cut by a plane which is parallel with the arranging direction of the sun roller 40 the pair of planetary rollers 50.

The pump unit 3 includes a rigid ring 20, an elastic ring 30, the sun roller 40, the pair of planetary roller 50 and a rotor 60. The rotor 60 is illustrated only in FIG. 2 and is omitted in the other drawings for the sake of simplicity.

As shown FIG. 3, the rigid ring 20 includes a cylindrical part 21, a projecting part 22 having a U-shaped lateral cross section formed such that a part (an upper edge part in FIG. 3) of the cylindrical part 21 is projected outward, and a sucking port 23 and a discharging port 24 each of which is formed of a pipe extending perpendicularly from both of left and right surfaces of the projecting part 22 (in the left and right direction in FIG. 3).

As shown in FIG. 4(*a*), an inner circumferential surface (an inner wall surface) 21*a* of the cylindrical part 21 of the rigid ring 20 is not a cylindrical surface but is a taper surface (a conic surface, specifically a lateral surface of a truncated cone) formed such that the inner diameter increases toward the rear side (the drive unit 2 side). Further, the inner wall surface 21*a* has a curvature in a projecting shape where a central part of the inner wall surface 21*a* in the axis direction is projected outward. That is, the inner wall surface 21*a* is formed in a barrel-shape. As described in later, this curvature is provided to form an operation chamber C between the inner wall surface 21*a* and an outer circumferential surface 31*a* of a cylindrical part 31 of the elastic ring 30. By providing the taper surface on the inner wall surface 21*a*, it becomes possible to put out the cylindrical part 21 having the barrel-shaped hollow part 21*h* from a metal mold without using a complicated metal mold, such as a slid die, for example, when the cylindrical part 21 is processed with a metal mold such as injection molding. As a result, processing cost can be reduced.

Figure 5:
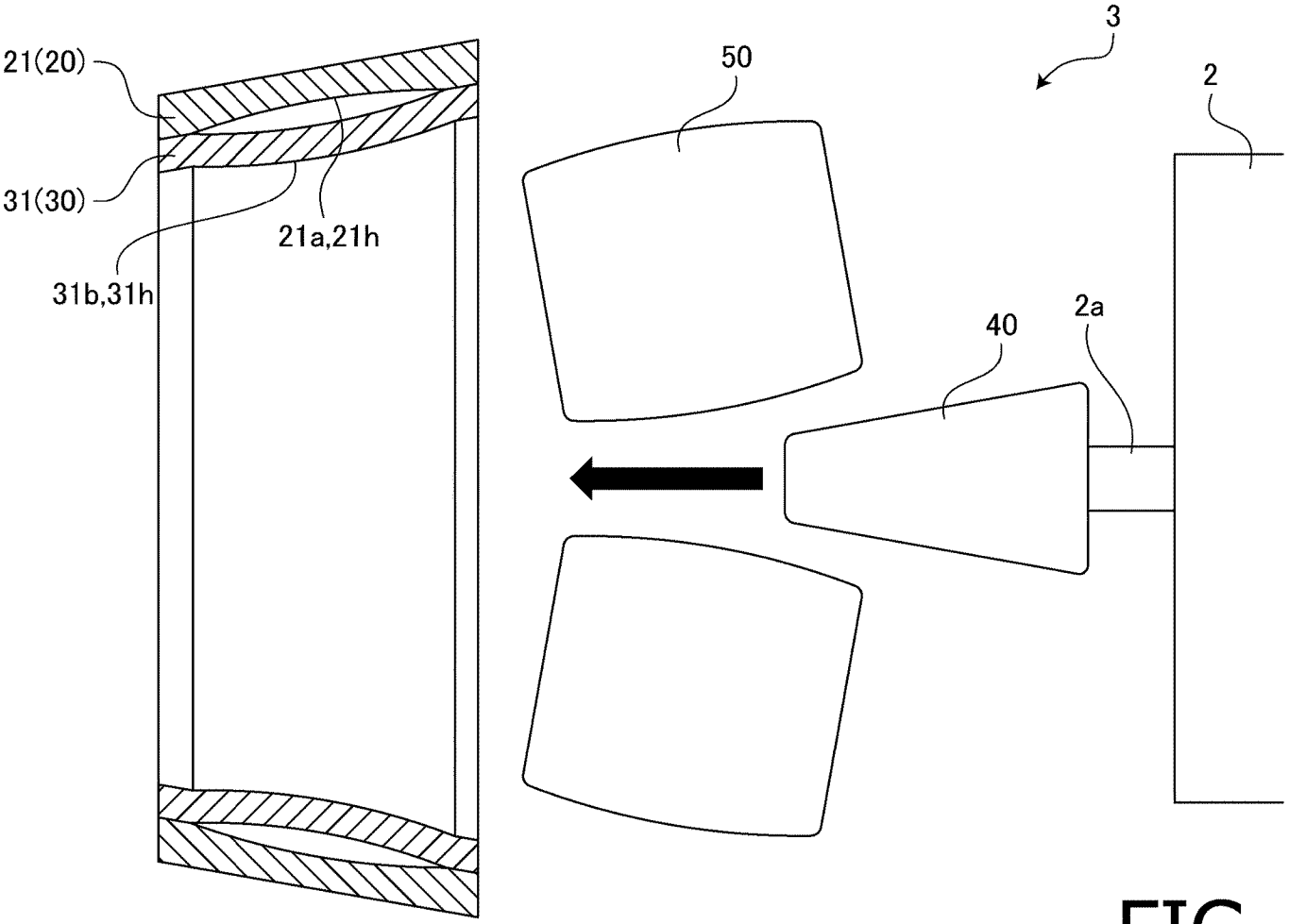
FIG. 5 is an explanatory illustration for explaining an assembling manner of the pump unit.

FIG. 5 is an explanatory illustration for explaining an assembling manner of the pump unit 3. As shown in FIG. 5, when the pump unit 3 is assembled, first the elastic ring 30 is attached to the hollow part of the rigid ring 20, and then components including the sun roller 40, the pair of planetary rollers (pressing members) 50 and the rotor 60 are inserted into the hollow part 31*h* of the elastic ring 30 from the rear side of the elastic ring 30 having a lager diameter. As described above, the inner wall surface 21*a* of the rigid ring 20 (and the cylindrical part 31 of the elastic ring 30) is formed in a barrel surface shape or a conical surface shape having the taper shape where the inner diameter thereof increases toward the rear side opening (an entrance for insertion) through which the assembling members such as the sun roller 40 are inserted into the cylindrical part 21. With this configuration, insertion of the components of the pump 30 into the rigid ring 20 and the assembling become easy, and work for repair, inspection and exchange of parts also becomes easy.

As shown in FIG. 3, in the inside of the projecting part 22, a hollow part 22*a* (a groove 22*a*) extending in the direction of the center axis AX is formed. The groove 22*a* communicates with the hollow part 21*h* of the cylindrical part 21. Further, hollow parts of the sucking port 23 and the discharging port 24 communicate with each other via the groove 22*a* of the projecting part 22, and forms one linear hollow part 25. Further, the hollow part 25 communicates with the hollow part 21*h* of the cylindrical part 21 via the groove 22*a*. The rigid ring 20 is formed of structural materials, such as metal or engineering plastic which is rigid and excellent in a solvent resistance property. In the hollow part 21*h* of the rigid ring 20, the cylindrical elastic ring 30 is accommodated.

As shown in FIG. 3, the elastic ring 30 includes the cylindrical part 31, and a thin plate-like division wall 34 formed to project from the outer circumferential surface 31*a* of the cylindrical part 31. The division wall 34 separates the hollow part 21*h* of the cylindrical part 21 and the groove 22*a* of the projecting part 22 into a space communicating with the sucking port 23 and a space communicating with the discharging port 23. The elastic ring 30 is formed of elastomer having excellent solvent resistance and chemical resistance, and the cylindrical part 31 has an adequate thickness to the extent that the cylindrical part 31 does not expand and contract by hydraulic pressure.

As shown FIG. 4(*a*), the outer circumferential surface 31*a* of the cylindrical part 31 of the elastic ring 30 has the curvature such that, in the vertical cross section (i.e., in the axis direction), the outer circumferential surface 31*a* is projected to the inner side, and is formed in shape of a bobbin type recessed curved surface. Further, as described above, the inner wall surface 21*a* of the cylindrical part 21 of the rigid ring 20 has the curvature in the shape projecting to the outer side in the vertical cross section (the the barrel type projected curved surface). Therefore, as shown in FIG. 4(*a*), in the state where the elastic ring 30 is not pressed against the rigid ring 20 by the planetary roller 50, the operation chamber C is formed between the outer circumferential surface 31*a* of the elastic ring 30 and the inner wall surface 21*a* of the rigid ring 20. The cylindrical part 31 of the elastic ring 30 is adhered to the cylindrical part 21 of the rigid ring 20 by adhesion or crimping at the both ends of the cylindrical part 31 in the front and rear direction (the direction of the center axis AX). As a result, the operation chamber C is hermetically sealed.

The both surfaces of the cylindrical part 31 of the elastic ring 30 are also formed to be inclined with respect to the center axis AX by the same angle as that of the inner wall surface 21*a* of the rigid ring 20. The cylindrical part 31 has a uniform thickness so that the pressure applied to the cylindrical apart 31 by the planetary roller 50 becomes uniform.

In the hollow part 31*h* of the elastic ring 30, the rotor 60, and the sun roller 40 and the pair of planetary rollers 50 held by the rotor 60 are accommodated.

As shown in FIG. 2, the rotor 60 is formed of members including a front rotor member 62 and a rear rotor member 64 made of structural material, such as engineering plastic or metal. The sun roller 40 and the planetary rollers 50 are sandwiched between the front rotor member 62 and the rear rotor member 64. Each of the sun roller 40 and the planetary rollers 50 is rotatably supported about the center axis thereof while being sandwiched between the front rotor member 62 and the rear rotor member 64. The sun roller 40 is disposed to be coaxially with the rotor 60 (i.e., the center axis AX of the pump unit 3).

As shown in FIG. 4(*b*), the sun roller 40 is formed in a shape of a truncated cone. The sun roller 40 and the pair of planetary rollers 50 are held by the rotor 60 in a state where the outer circumferential surfaces of the sun roller 40 and the planetary roller 50 strongly contact with each other. Specifically, the pair of planetary rollers 50 are disposed such that the rotational axes thereof are inclined along the outer circumferential surface (i.e., inclined by a tapered angle of the outer circumferential surface) of the sun roller 40 in a state where the planetary rollers 50 sandwich the sun roller 40 from the both sides in the radial direction. Therefore, the rotational driving force of the sun roller 40 is transmitted to each of the planetary roller 50 by friction between the sun roller 40 and the planetary rollers 50.

Further, the rotor 60 is held to be freely rotatable about the center axis AX with respect to the rigid ring 20 and the elastic ring 30. Further, in the rear rotor member 64, a through hole is formed on the center axis AX to allow the drive shaft 2*a* to penetrate therethrough.

An axis hole is formed in the rear part of the sun roller 40 to extend on the center axis AX, and the drive shaft 2*a* of the drive unit 2 is fitted into the axis hole. Therefore, the sun roller 40 is driven and rotated directly by the drive unit 2.

The pair of planetary rollers 50 rolls on the outer circumferential surface of the sun roller 40 (and on the inner circumferential surface 31*b* of the elastic ring 30) in a state where the planetary rollers 50 are sandwiched between the sun roller 40 and the elastic ring 30. At this time, a relative positional relationship between the sun roller 40 and the pair of planetary rollers 50 is kept constant by the rotor 60.

Figure 6:
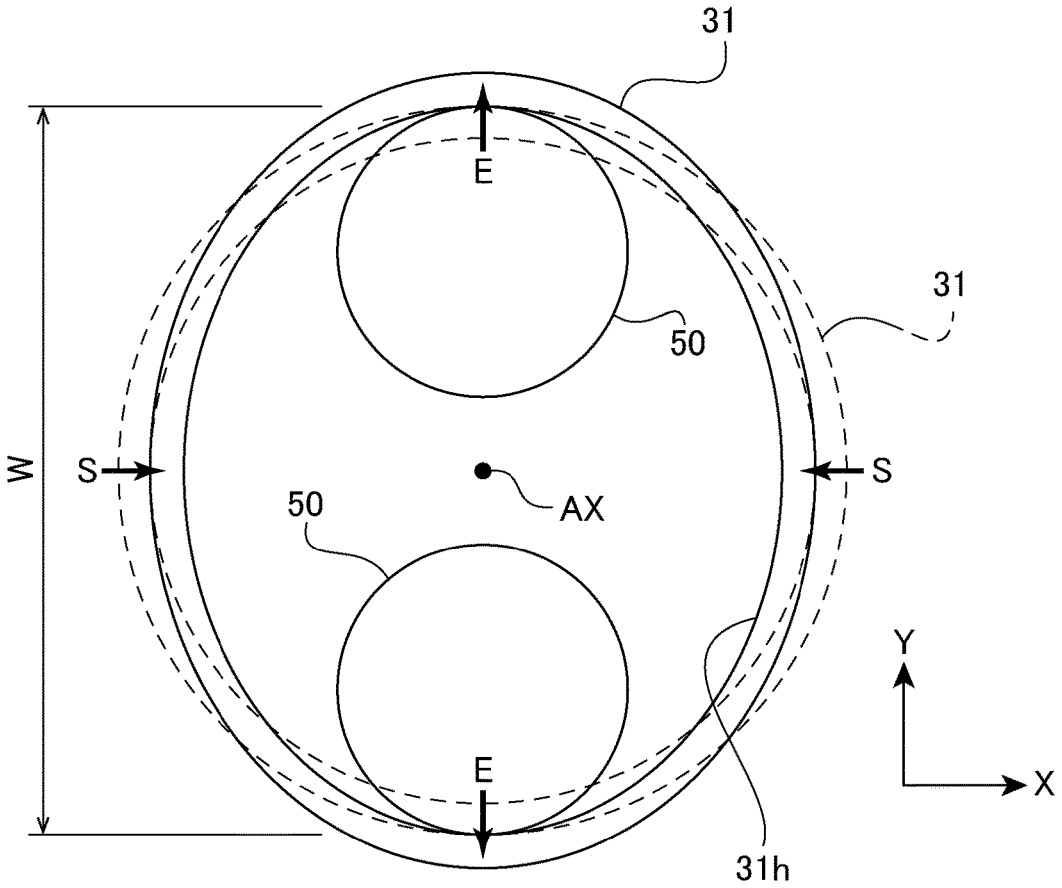
FIG. 6 is an explanatory illustration for explaining behavior of an elastic ring.

Hereafter, behavior of the elastic ring 30 during operation of the pump device 1 is explained. FIG. 6 is a lateral cross section illustrating the behavior of the cylindrical part 31 of the elastic ring 30. In FIG. 6, a dashed line assigned the reference number 31 shows the cylindrical part 31 in a natural state, and a solid line assigned the reference number 31 shows the cylindrical part 31 in a state where the diameter of the cylindrical part 31 is expanded in Y-axis direction by accommodating the pair of planetary rollers 50 in the hollow part 31*h*.

In a natural state, the inner diameter of the cylindrical par 31 is narrower than the outer width W (the diameter of a circle circumscribing the pair of planetary rollers 50). Therefore, as shown by arrows E, positions at which the cylindrical part 31 contacts the planetary rollers 50 are pressed and expanded outward in the radial direction. That is, the diameter of the cylindrical part 31 is expanded in the Y-axis direction along which the pair of planetary rollers 50 are arranged. On the other hand, in the X-axis direction perpendicularly intersecting with the arranging direction of the planetary rollers 50, the diameter of the cylindrical par 31 contracts as shown by arrows S. Since the pair of planetary roller 50 rotate at a constant speed around the center axis AX, every part of the cylindrical part 31 periodically repeats diameter-expanding and diameter-contracting. Since in a natural state the diameter of the outer circumferential surface 31*a* of the cylindrical part 31 is smaller than the diameter of the inner wall surface 21*a* of the rigid ring 20, a ring-shaped space (the operation chamber C) is formed between the inner wall surface 21*a* and the outer circumferential surface 31*a* before the components, such as the planetary rollers 50, are accommodated in the hollow part 31*h* of the elastic ring 30. When the pair of planetary rollers 50 are accommodated in the hollow part 31*h* and the cylindrical part 31 is pressed from the inner side by the pair of planetary rollers 50, the cylindrical part 31 deforms in an elliptical shape as shown by the solid line and concurrently is pressed against the inner wall surface 21*a*. As a result, at the portions pressed by the pair of planetary rollers 50, the elastic ring 30 contacts locally and closely a part of the inner wall surface 21*a* of the rigid ring 20 in the circumferential direction, and forms a blocking part in the operation chamber C extending in the circumferential direction, so that the operation chamber is divided in the circumferential direction.

In this embodiment, the length (the circumference) of the elastic ring 30 in the circumferential direction is set to be a predetermined length. Specifically, the circumference of the elastic ring 30 is set such that, when the elastic ring 30 is pressed from the inner side by the pair of planetary roller 50 in the radial direction and is deformed in an elliptical shape, the elastic ring 30 forms the blocking part in the operation chamber C while closely contacting the inner wall surface 21*a* of the rigid ring 20 in a state where the circumference of the elastic ring 30 does not substantially change, and divides the operation chamber C in an airtight manner. That is, when the sun roller 40 and the pair of planetary rollers 50 are inserted into the hollow part 31*h* of the elastic ring 30, the elastic ring 30 is expanded from the inner side by the pair of planetary rollers 50 and deforms in an elliptical shape. Then, the outer circumferential surface 31*a* of the elastic ring 30 closely contacts the inner wall surface 21*a* of the rigid ring 20 at the both ends in the major axis direction, and forms the two blocking parts in the operation chamber C, so that the operation chamber C is divided into two portions. At this time, the diameter of the elastic ring 30 in the minor axis direction becomes shorter than that in a natural state, and thereby increase of the circumference caused by expansion of the diameter of the elastic ring 30 in the major axis direction is absorbed, and as a result change of the total length of the circumference of the elastic ring 30 is adequately suppressed. Specifically, the elastic ring 30 deforms (i.e., the bending shape is stretched) such that, at the portion (the portion extending between the planetary rollers 50) not contacting the plurality of planetary rollers 50, the curvature in the circumferential direction becomes smaller than a natural state by the tension applied to the elastic ring 30, so that the circumference does not increase. The thickness of the cylindrical part 31 of the elastic ring 30 is set to the extent that the thickness of the cylindrical part 30 is not substantially changed by the tension in the circumferential direction applied to the cylindrical part 31. The term circumference of the elastic ring 30 means the circumference at the central position in the thickness direction of the elastic ring 30. When the elastic ring 30 is elastically deformed in an elliptical shape and the curvature of the elastic ring 30 in the circumferential direction is changed, the inner circumferential surface 31*b* and the outer circumferential surface 31*a* elastically deform and the circumferences of the inner circumferential surface 31*b* and the outer circumferential surface 31*a* slightly change, but the circumference at the central position in the thickness direction hardly expands and contracts because the change of the circumference is absorbed by deformation at the inner and outer circumferential surfaces. As a result, it becomes possible to reduce aging variation such as fatigue by expansion and contraction of the cylindrical part 31 and thereby it becomes possible to enhance durability.

As described above, the length of the circumference of the elastic ring 30 is defined such that the circumference of the elastic ring 30 does not substantially expand and contract at least in the circumferential direction during the pumping operation. In other words, the elastic ring 30 elastically deforms in an elliptical shape when the elastic ring 30 is pressed from the inner side by the planetary rollers 50; however, by setting the circumference of the elastic ring 30 to be the predetermined length, even when the elastic ring 30 deforms in this way, the outer circumferential surface 31*a* of the cylindrical part 31 and the inner circumferential surface 21*a* of the rigid ring 20 closely contact with each other and thereby form the blocking part in the state where the length of the elastic ring 30 in the circumferential direction hardly changes, and the operation chamber C is divided in an airtight manner. The fact that the length of the elastic ring 30 does not substantially expand and contract means that the elastic ring 30 hardly expands and contracts in the circumferential direction by the pressure from the planetary rollers 50 and the inner pressure applied to the operation chamber C. By thus configuring the elastic ring 30 so that the circumference of the elastic ring 30 does not substantially expand and contract, it becomes possible to reduce the aging variation such as fatigue by expansion and contraction of the elastic ring 30 and to enhance the durability. Since the elastic ring 30 has an adequate thickness, the elastic ring 30 has reasonable rigidity. As a result, it becomes possible to adequately decrease change of volume by the inner pressure of the operation chamber C. The fact that the change of volume is adequately decreased means, for example, that the change of volume of the operation chamber C defined when the maximum discharging pressure is applied to the operation chamber C is smaller than or equal to 10% (preferably smaller than or equal to 5%, and more preferably smaller than or equal to 1%). Since the circumference of the elastic ring 30 is defined such that the elastic ring 30 does not substantially expand and contract in the circumferential direction during operation, it becomes possible to reduce fatigue by expansion and contraction and to enhance durability. Furthermore, even when the inner pressure of the operation chamber C increases, it is possible to avoid occurrence of a situation where the elastic ring 30 expands and the volume of the operation chamber C expands and as a result efficiency for transporting fluid is decreased. Furthermore, with this configuration, it becomes possible to achieve an extremely high degree of durability or discharging pressure and sacking pressure in comparison with the case where a diaphragm which expands and contracts during the pumping operation is used.

The periodic deformation (the diameter-expanding and the diameter-contracting) of the cylindrical part 31 is not caused by a relatively weak elastic restoring force, but is forcibly caused by a strong external force applied by the pair of planetary rollers 50. Therefore, required time for the periodic deformation is short. Accordingly, even when the planetary roller 50 is rotated at a high speed, deformation of the cylindrical part 31 is able to follow motion of the planetary roller 50.

In the meantime, in a tube pump, a discharging process is performed by forcibly pressing a tube by a roller, while a sucking process is performed by a relatively weak elastic restoring force of an elastic tube (a self-restoration force). Therefore, time required for the discharging process is short, but time required for the sucking process is long. For this reason, there was a case where, when the tube pump is driven at a high speed (a roller is rotated at a high speed), restoration of the elastic tube cannot follow the cycle of rotation of the roller and thereby the transporting efficiency of liquid decreases because a next discharging process starts before the current sucking process is finished. According to the configuration of the pump unit 3 of the embodiment, higher motion than that of the tube pump can be achieved.

In FIG. 4(*b*), the elastic ring 30 is in a diameter-expanded state of being expanded in a direction (a radial direction) from the inner side by the pair of planetary rollers 50. In FIG. 4(*a*), the elastic ring 30 is in a diameter-contracted state where the diameter of the elastic member is contracted.

In the diameter-contracted state (a diameter-contracted direction) in FIG. 4(*a*), the outer diameter of the cylindrical part 31 of the elastic ring 30 is smaller than the inner diameter of the cylindrical part 21 of the rigid ring 20, and a space (the operation chamber C) is formed between the outer circumferential surface 31*a* of the cylindrical part 31 of the elastic ring 30 and the inner wall surface 21*a* of the rigid ring 20.

In the diameter-expanded state (a diameter-expanded direction) in FIG. 4(*b*), the diameter of the cylindrical part 31 of the elastic ring 30 is expanded in the diameter direction in which the pair of planetary rollers 50 are arranged, and the outer circumferential surface 31*a* closely contacts the inner wall surface 21*a* of the rigid ring 20. As a result, in the vicinity of the planetary roller 50, the ring-shaped operation chamber C is locally closed.

Furthermore, as shown in FIG. 4(*a*), in the diameter-contracted state, the outer circumferential surface 31*a* of the elastic ring 30 is given the same curvature as that of the inner wall surface 21*a* of the rigid ring 20 in the center axis direction AX. Regarding the length in the direction of the curvature (i.e., the length in FIG. 4(*a*)), the inner wall surface 21*a* of the rigid ring 20 and the outer circumferential surface 31*a* of the elastic ring 30 have the same length. Therefore, as shown in FIG. 4(*b*), when the elastic ring 30 is sandwiched between the planetary roller 50 and the rigid ring 20, the outer circumferential surface 31*a* of the elastic ring 30 closely contacts the inner wall surface 21*a* of the rigid ring 20 without slacking.

Furthermore, as described above, the cylindrical part 31 of the elastic ring 30 has the uniform thickness, and, as shown in FIG. 4(*b*), when the outer circumferential surface 31*a* of the elastic ring 30 closely contacts the inner wall surface 21*a* of the rigid ring 20, the outer circumferential surface 31*a* of the elastic ring 30 gets warped in the same direction as that of the inner wall surface 21*a* of the rigid ring 20. Therefore, at this time, the inner wall surface 31*b* of the elastic ring 30 is also bent to project outward as in the case of the inner wall surface 21*a* of the rigid ring 20. The outer circumferential surface of the planetary roller 50 is also formed in a barrel shape bent to have substantially the same curvature as that of the inner wall surface 21*a* of the rigid ring 20 so that uniform pressure can be applied to the inner wall surface 31*b* of the elastic ring 30 bent as described above.

In the expanded state, the operation chamber C is pressed by the planetary rollers 50, and is divided into two parts. When each planetary roller 50 rotates around the sun roller 40, the blocking part of the operation chamber C also moves in the circumferential direction along the inner wall surface 21*a* of the rigid ring 20 together with the planetary roller 50, and thus the liquid stored in the operation chamber C is transported.

As described above, in the pump unit 3 according to the embodiment, the rotation motion of the sun roller 40 is converted to the rotating motion (orbital revolution) of the planetary roller 50 along the inner wall surface 21*a* of the rigid ring 20, and the liquid in the operation chamber C is moved along the inner wall surface 21*a* of the rigid ring 20 by rotation of the planetary rollers 50. Since the inner circumferential length of the elastic ring 30 is longer than the outer circumferential length of the sun roller 40, the speed of the rotation motion of the sun roller 40 is reduced, and thereby the planetary roller 50 rotates at a speed slower than that of the sun roller 40. That is, a rotational driving force transmitting mechanism constituted by the sun roller 40, the planetary rollers 50 and the elastic ring 30 provided in the pump unit 3 has the speed reduction function like a planetary gear mechanism. Therefore, it is not necessary to provide a speed reduction device in the drive unit 2 side, and, as a result, a simple and compact configuration is achieved.

Furthermore, the pump unit 3 according to the embodiment is provided with the two planetary rollers 50. Therefore, each time the rotor 60 makes one revolution, every part on the circumference of the elastic ring 30 alternately repeats, two times, the diameter-expanded state of being pressed by the planetary roller 50 and closely contacting the rigid ring 20 and the diameter-contracted state of being separated from the rigid ring 20 and forming the operation chamber C. That is, each time the rotor makes one revolution, sucking and discharging are performed by two cycles. Therefore, since the number of cycles per one revolution of the rotor is larger in comparison with the pump formed to use a single planetary roller or an eccentric rotor as described in the patent document 2 (U.S. Patent Application Publication No. 2012/0020822), pulsation motion is smoothed and thereby smooth pumping can be achieved. Furthermore, the transporting amount of liquid per one revolution of the rotor is increased, and thereby the transporting efficiency can be enhanced.

Hereafter, operation of the pump device 1 is explained. For example, when a control signal for instructing activation of the pump device 1 is externally inputted, the drive unit 2 drives and rotates the drive shaft 2*a* based on the control signal. Since, as described above, the sun roller 40 (a body part) is coaxially fixed to the tip part of the drive shaft 2*a*, the sun roller 40 is rotated together with the drive shaft 2*a*.

When the sun roller 40 is rotated in a direction of an arrow A1 as shown in FIG. 3, the rotational driving force of the sun roller 40 is transmitted by the frictional force to the pair of planetary rollers 50 whose outer circumferential surfaces contact with the outer circumferential surface of the sun roller 40. As a result, each planetary roller 50 rotates in a direction of an arrow A2. At this time, since each planetary roller 50 also receives a frictional force from the inner circumferential surface 31*b* of the elastic ring 30, each planetary roller 50 is rotated (makes an orbital revolution) by the frictional force in a direction of an arrow A3 along the inner circumferential surface 31*b* of the elastic ring 30. Consequently, each operation chamber C moves along the inner wall surface 21*a* of the rigid ring 20. It should be noted that the elastic ring 30 does not rotate, and repeats the diameter-expanding and the diameter-contracting in accordance with revolution of the planetary rollers 50.

Around the grove 22*a*, the operation chamber C is divided into operation chambers C1 and C2 by the division wall 22*a*. The operation chamber C1 communicates with the sucking port 23, and the operation chamber C2 communicates with the discharging port 24. When the operation chamber C communicates with the groove 22*a*, the operation chamber C1 gradually expands (concurrently the operation chamber C2 gradually contracts) as the operation chamber C moves in the clockwise direction in FIG. 3, and the liquid flows into the operation chamber C1 from the sucking port 23. When the operation chamber C is subsequently blocked from the groove 22*a*, the operation chamber C moves along the inner wall surface 21*a* of the rigid ring 20 (in the clockwise direction in FIG. 3) while keeping a constant volume. Then, the operation chamber C communicates with the groove 22*a* again, and the operation chamber C2 gradually contracts in accordance with movement of the operation chamber C, and the liquid is pushed out from the operation chamber C2 to the discharging port 24. Thus, transporting of the liquid by the pump device 1 is performed.

In the pump unit 3 according to the embodiment, the width of the groove 22*a* of the rigid ring 20 is sufficiently small relative to (e.g., smaller than or equal to ⅓ of) the diameter of the planetary roller 50, and the elastic ring 30 has the thickness substantially equal to the width of the groove 22*a*. Therefore, when the planetary roller 50 passes through the groove 22*a* of the rigid ring 20, a force which the planetary roller 50 receives from the rigid ring 20 does not change largely. Therefore, since the sun roller 40 constantly receives balanced forces from the pair of planetary rollers 50, the sun roller 40 does not vibrate largely in the radial direction. As a result, the sun roller 40 does not produce a large degree of noise, and life of the sun roller 40 is also enhanced.

Since, in the pump unit 3 according to the embodiment, the sun roller 40, the pair of planetary rollers 50 and the rotor 60 rotate about the barycenter (a point on the center axis AX), vibration and noise are not caused by fluctuation of the barycenter during operation of the pump unit 3. Furthermore, since the sucking and discharging are performed at constant time intervals (pulsation motion is produced at a constant cycle), fluctuation of the discharging amount of the liquid can be reduced.

In this embodiment, the configuration where the pair of planetary rollers 50 are disposed to sandwich the center axis AX and to have the same distances with respect to the center axis AX is used. Specifically, the pair of planetary rollers 50 are disposed, for example, in a rotationally-symmetrical manner with respect to the center axis AX or in a plane symmetrical manner with respect to a plane including the center axis AX. As a result, pressing forces applied from the planetary rollers 50 to the sun roller 40 are cancelled out, and balance during rotation of the sun roller 40 is enhanced and the noise and vibration can be reduced.

It is not necessarily required to have a pair of (two) planetary rollers 50, but three or more planetary rollers 50 may be used. In such a case, a plurality of planetary rollers 50 may be symmetrically disposed with respect to the center axis AX and/or may be disposed around the center axis AX at constant intervals along the circumferential direction around the center axis AX. With this configuration, it becomes possible to prevent the barycenter position of the entire of the plurality of planetary rollers 50 and the elastic ring 30 from moving, and thereby it becomes possible to reduce the vibration and noise during operation. Furthermore, fluctuation of the discharging amount of liquid can be reduced.

The above described embodiment is configured such that the barycenter of the cylindrical part 31 of the elastic ring 30 does not move or the cylindrical part 31 of the elastic ring 30 deforms (expands and contracts) in a symmetrical manner with respect to the barycenter. Therefore, the cylindrical part 31 of the elastic ring 30 does not move, at the diameter-expanded part thereof (at positions indicated by reference symbols S in FIG. 6), in parallel with the cylindrical part 21 of the opposing rigid ring 20 (i.e., the cylindrical part 31 does not slide in the up and down direction in FIG. 6). As a result, applying of a shearing force to the elastic ring 30 is prevented, and thereby progressing of the fatigue can be prevented. It should be noted that, in a configuration where only one planetary roller 50 is provided as in the case of the patent document 2, the elastic ring 30 may be decentered to the planetary roller 50 side with respect to the rigid ring 20. Therefore, in such a case, a large degree of shearing force is applied to the elastic ring 30 at the position indicated by the reference symbol S in FIG. 6, and life of the elastic ring 30 is reduced.

The rotational driving force transmitting mechanism including the sun roller 40, the planetary rollers 50 and the elastic ring 30 according to the embodiment may be used for another type of rotational pump, such as, a tube pump in which an elastic tube is used as an operation chamber.

The forgoing is the explanation about the embodiment of the invention; however, the invention is not limited to the above described configuration according to the embodiment but may be varied in various ways within the scope of the invention.

Figure 7:
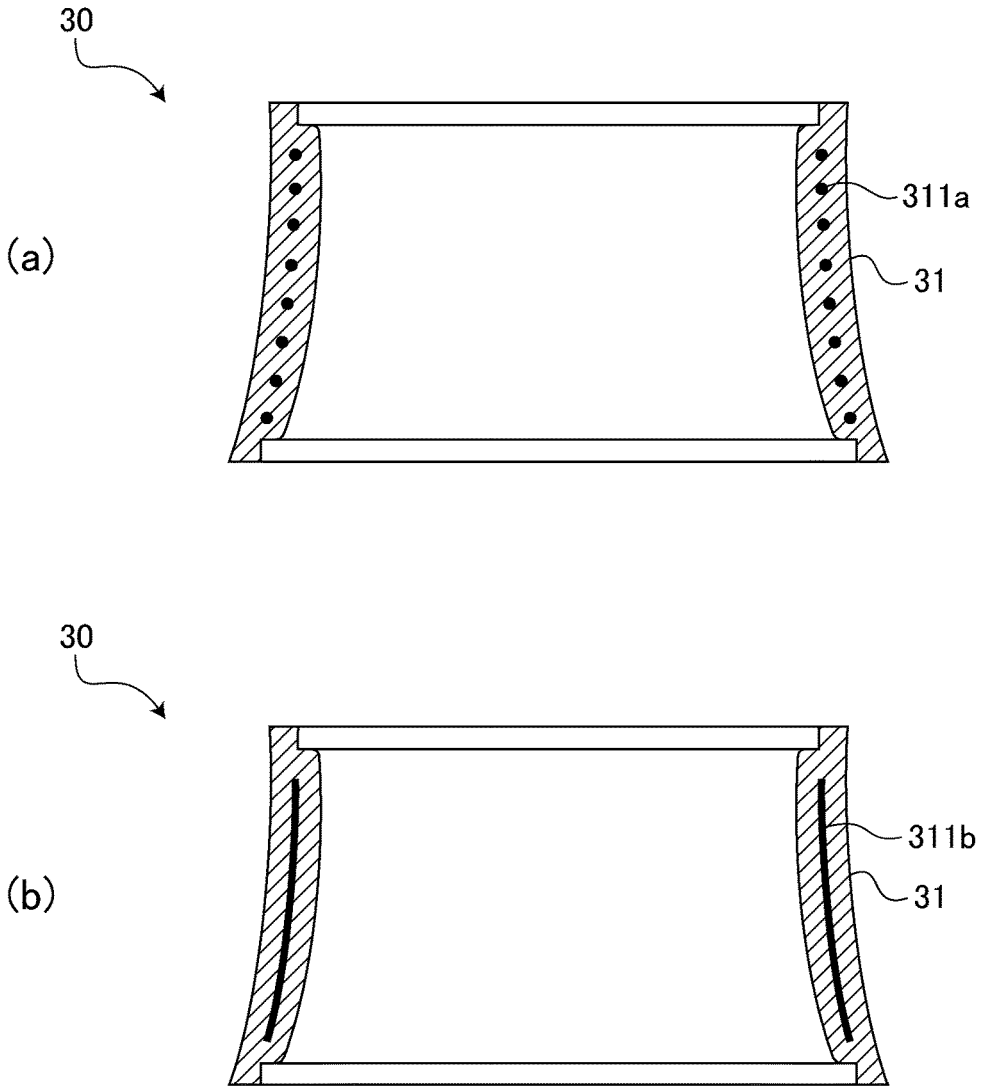
FIG. 7 is a vertical cross section of a variation of the elastic ring.

The above described embodiment is an example in which the elastic ring 30 is formed of a single material; however, the elastic ring 30 may be formed of a combination of material having elasticity and material not having a large degree of elasticity (expansion/contraction suppressing material). For example, as shown FIG. 7, the elastic ring 30 may be configured such that expansion/contraction suppressing material 311*a* and 311*b* having a low degree of elasticity is buried in the cylindrical part 31 formed of base material having elasticity. In this case, the expansion/contraction suppressing material 311*a* and 311*b* have a large degree of flexibility. FIG. 7(*a*) illustrates a variation in which the expansion/contraction suppressing material 311*a* wound in a spiral shape is buried in the cylindrical part 31. FIG. 7(*b*) illustrates a variation in which a film-like expansion/contraction suppressing material 311*b* wound in a cylindrical shape is buried in the cylindrical part 31. By thus combining the material having a low degree of elasticity, it becomes possible to enhance the strength of the elastic ring 30 and to enhance the durability.

In the above described embodiment, the sun roller 40 having a conical outer circumferential surface inclined with respect to the center axis by the same angle as that of the inner wall surface 21*a* of the rigid ring 20 is used, and the center axis of the planetary roller (presser roller) 50 is inclined with respect to the center axis of the rigid ring 20 by the same angle as that of the inner wall surface 21*a*. However, the present invention is not limited to such a configuration. For example, the outer circumferential surface of the sun roller 40 may not be formed as the taper surface, but the planetary roller 50 having a conical outer circumferential surface inclined with respect to the center axis by the same angle as that of the inner wall surface 21*a* of the rigid ring 20 may be used.

In the above described embodiment, a planetary roller mechanism in which the sun roller 40 and the planetary rollers 50 are used and the driving force is transmitted by the frictional force between the rollers is used. However, the present invention is not limited to such a configuration. For example, a sun gear and a planetary gear (a planetary gear mechanism) may be used in place of the sun roller 40 and the planetary rollers 50. In such a case, an inner gear may be provided on the inner circumferential surface of the elastic ring 30 to engage with the planetary roller 50. Furthermore, the planetary gear mechanism may not be provided, but the rotor 60 may be directly driven by the drive unit 2. In such a case, it becomes necessary to provide a reduction gear for amplifying torque in the drive unit 2.

When liquid having a low degree of light resistance property is transported, the casing 5 and/or the elastic ring 30 may be formed of material having a light shielding property (or an ultraviolet shielding property).

The above described embodiment is an example in which the present invention is applied to a liquid transporting pump which transports liquid; however, the present invention may be applied to an air transporting pump which transports air. Further, the present invention can be used in a wide range of technical fields, such as, medical care, water treatment, water supply, agriculture, shipping and construction, as well as a whole industrial field including the food industry and the chemical industry.

What is claimed is:

1. A pump, comprising:

an inner wall surface having a cylindrical shape;

an elastic ring positioned within the inner wall surface, the elastic ring curving toward a center axis of the elastic ring and away from the inner wall surface in a direction of the center axis such that the elastic ring forms an operation chamber between the inner wall surface and an exterior surface of the elastic ring extending in a circumferential direction of the elastic ring; and a plurality of pressing members pressing a part of the elastic ring in the circumferential direction away from the center axis of the elastic ring and toward the inner wall surface and thereby forming a blocking part in the operation chamber, the plurality of pressing members causing fluid in the operation chamber to move by rotating along the inner wall surface and thereby moving the blocking part, wherein the inner wall surface curves away from the center axis of the elastic ring in the direction of the center axis and is tapered such that a diameter of the inner wall surface expands toward one side in an axial direction of the inner wall surface.

2. The pump according to claim 1, wherein:

a diameter of the inner wall surface is larger than an outer diameter of the elastic ring in a static state, the static state being a state in which no external force is applied to the elastic ring;

a difference between the diameter of the inner wall surface and the outer diameter of the elastic ring in the static state is defined to achieve a relationship that, when the elastic ring deforms due to a pumping motion, the elastic ring contacts the inner wall surface while causing no change with respect to the circumference of the elastic ring.

3. The pump according to claim 1, wherein:

an inner diameter of the elastic ring in a static state is smaller than a diameter of a circumscribed circle of outer circumferences of the plurality of pressing members, the static state being a state in which no external force is applied to the elastic ring; and the elastic ring is configured not to expand the circumference of the elastic ring by deforming, at a part of the elastic ring not contacting the plurality of pressing members, such that curvature in the circumferential direction becomes smaller than curvature in the static state.

4. The pump according to claim 1, wherein:

the inner wall surface is formed with a sucking port through which the fluid to be transported is sucked from an outside into the operation chamber, and is formed with a discharging port through which the fluid is discharged from an inside of the operation chamber to the outside;

the elastic ring includes a division wall partitioning the operation chamber between the sucking port and the discharging port; and the division wall is an elastic plate-like member projecting from an outer circumferential surface of the elastic ring.

5. The pump according to claim 1, wherein a barycenter of the plurality of pressing members lies on a center axis of rotation of the plurality of pressing members.

6. The pump according to claim 5, wherein the plurality of pressing members are disposed around a center axis of the inner wall surface at constant intervals.

7. The pump according to claim 1, further comprising a rotor rotating the plurality of pressing members along an inner circumferential surface of the elastic ring while holding the plurality of pressing members to maintain a predetermined positional relationship of the plurality of pressing members.

8. The pump according to claim 7, further comprising a sun roller disposed coaxially with a center axis of rotation of the plurality of pressing members, wherein:

each of the plurality of pressing members is a pressing roller rotatably supported by the rotor;

when the sun roller rotates, the plurality of pressing members being sandwiched between the sun roller and the inner circumferential surface of the elastic ring rotate in the circumferential direction along an outer circumferential surface of the sun roller and the inner circumferential surface of the elastic ring; and the elastic ring is configured such that the plurality of pressing members and the sun roller can be inserted into a hollow part of the elastic ring from one side in an axis direction of the hollow part for assembling.

9. The pump according to claim 8, wherein pressing forces applied from the plurality of pressing members to the sun roller are cancelled out.

10. The pump according to claim 1, wherein an outer circumferential surface of the elastic ring is tapered such that a diameter of the outer circumferential surface expands toward the one side in the axial direction.

11. A pump, comprising:

an inner wall surface having a cylindrical shape;

an elastic ring positioned within the inner wall surface and forming an operation chamber extending in a circumferential direction of the elastic ring with respect to the inner wall surface, the elastic ring having a uniform thickness; and a plurality of pressing members pressing a part of the elastic ring in the circumferential direction against the inner wall surface and thereby forming a blocking part in the operation chamber, the plurality of pressing members causing fluid in the operation chamber to move by rotating along the inner wall surface and thereby moving the blocking part, wherein the inner wall surface is tapered such that a diameter of the inner wall surface expands toward one side in an axial direction of the inner wall surface, and the elastic ring deforms into an elliptical shape when the plurality of pressing members press a part of the elastic ring in the circumferential direction against the inner wall surface.

* * * * *